US008764402B2

(12) United States Patent
Agaram et al.

(10) Patent No.: US 8,764,402 B2
(45) Date of Patent: Jul. 1, 2014

(54) TURBOMACHINE BLADE LOCKING SYSTEM

(75) Inventors: Sukumar Agaram, Bangalore (IN); Narasimha K V Rao, Bangalore (IN)

(73) Assignee: General Electric Company, Schenectady, NY (US)

( * ) Notice: Subject to any disclaimer, the term of this patent is extended or adjusted under 35 U.S.C. 154(b) by 450 days.

(21) Appl. No.: 13/157,241

(22) Filed: Jun. 9, 2011

(65) Prior Publication Data

US 2012/0315144 A1 Dec. 13, 2012

(51) Int. Cl.
*F01D 5/32* (2006.01)

(52) U.S. Cl.
USPC ..... 416/220 R

(58) Field of Classification Search
USPC ..... 416/220 R, 221, 228, 219 A, 219 R, 416/204 R
See application file for complete search history.

(56) References Cited

U.S. PATENT DOCUMENTS 4,527,952 A 7/1985 Forestier
4,820,127 A 4/1989 Cohen
4,836,749 A * 6/1989 Gavilan ..... 416/221
5,584,659 A * 12/1996 Schmidt ..... 416/221
5,713,721 A 2/1998 Glynn et al.
5,720,596 A 2/1998 Pepperman
2008/0267781 A1 10/2008 Becker
2008/0273982 A1 11/2008 Chunduru et al.
2009/0077795 A1 3/2009 Prince et al.

FOREIGN PATENT DOCUMENTS

EP 0068923 A1 1/1983
EP 1584793 A2 10/2005

OTHER PUBLICATIONS

Search Report and Written Opinion from corresponding EP Application No. 12170316, dated Jul. 8, 2013.

* cited by examiner

*Primary Examiner* — Edward Look
*Assistant Examiner* — Maxine Adjagbe
(74) *Attorney, Agent, or Firm* — Fletcher Yoder P.C.

(57) ABSTRACT

Systems are disclosed herein for enhancing the longevity of turbomachine components. Such systems include a turbomachine blade that has a blade portion extending from a base portion. The base portion includes an axial rail configured to extend into an axial groove disposed in a rotor of a turbomachine. The axial rail includes a first locking recess configured to align with a second locking recess along the axial groove. The system also includes a blade locking assembly having a first locking insert and a second locking insert. The first locking insert is configured to be inserted in both the first and second locking recesses. The second locking insert is configured to be inserted in the first or second locking recess adjacent the first locking insert.

16 Claims, 4 Drawing Sheets

TURBOMACHINE BLADE LOCKING SYSTEM

BACKGROUND OF THE INVENTION

The disclosed subject matter relates to turbomachines and, more particularly, a locking system for blades.

In general, turbomachines transfer energy between a fluid and rotating blades. For example, a compressor is driven to rotate blades to compress a gas, such as air. By further example, a turbine includes blades, which are driven to rotate by a fluid flow, such as water, steam, or combustion gases. A typical turbomachine includes a large number of blades coupled to a rotor. Unfortunately, the rotor may be deformed during the attachment of the blades. For example, the blades may be staked or welded directly to the rotor, which deforms the rotor in the vicinity of the blades. At some point during the life of the turbomachine, the blades may be removed and replaced with new blades. As a result, the rotor may be repeatedly deformed during each successive blade replacement, eventually leading to problems attaching a new blade to the rotor. Therefore, a need exists to secure turbomachine blades to the rotor without repeatedly deforming the rotor.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a turbomachine blade that has a blade portion extending from a base portion. The base portion includes an axial rail configured to extend into an axial groove disposed in a rotor of a turbomachine. The axial rail includes a first locking recess configured to align with a second locking recess along the axial groove. The system also includes a blade locking assembly having a first locking insert and a second locking insert. The first locking insert is configured to be inserted in both the first and second locking recesses. The second locking insert is configured to be inserted in the first or second locking recess adjacent the first locking insert.

In accordance with a second embodiment, a system includes a turbomachine having a rotor with a first axial groove. The turbomachine also includes a first blade having a first axial rail disposed in the first axial groove and a locking space extending into the first axial groove and the first axial rail. The turbomachine includes at least one locking insert disposed in the locking space. At least one locking insert blocks movement of the first axial rail relative to the first axial groove in an axial direction.

In accordance with a third embodiment, a system includes a compressor having a first blade with a first axial mount. The compressor also includes a rotor having a second axial mount. The first and second axial mounts couple together in an axial direction to block movement of the first axial mount relative to the second axial mount in a radial direction and a circumferential direction. The compressor includes a locking space extending into the first axial mount and the second axial mount. The compressor also includes at least one locking insert disposed in the locking space. The at least one locking insert blocks movement of the first axial mount relative to the second axial mount in the axial direction.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments include a blade locking assembly configured to lock a blade to a rotor of a turbomachine without directly staking or otherwise deforming the rotor. The turbomachine may include a turbine, a compressor, or a combination thereof. For example, the blade locking assembly may be used to secure compressor blades in one or more stages of a compressor in a gas turbine engine. In certain embodiments, each blade is coupled to the rotor along a sliding joint, such as an axial rail and an axial groove. For example, the sliding joint may include a dovetail joint with a male portion and a female portion, which slide together in an axial direction relative to a rotational axis of the rotor. Furthermore, the blade locking assembly may include a plurality of inserts, which interface with one another between each blade and the rotor (e.g., along the sliding joint), thereby blocking axial movement of the blade relative to the rotor. In particular, rather than staking, welding, or otherwise deforming the rotor, the disclosed embodiments of the blade locking assembly may deform at least one of the inserts to hold the blade to the rotor along the sliding joint. For example, first and second inserts may be deformed relative to one another (e.g., by staking one of the inserts) to lock the inserts together, thereby blocking axial movement of the blade relative to the sliding joint. Although the disclosed embodiments are discussed in context of a compressor, any application involving attachment of a blade to a rotor may employ the blade locking assembly discussed in detail below.

Figure 1:
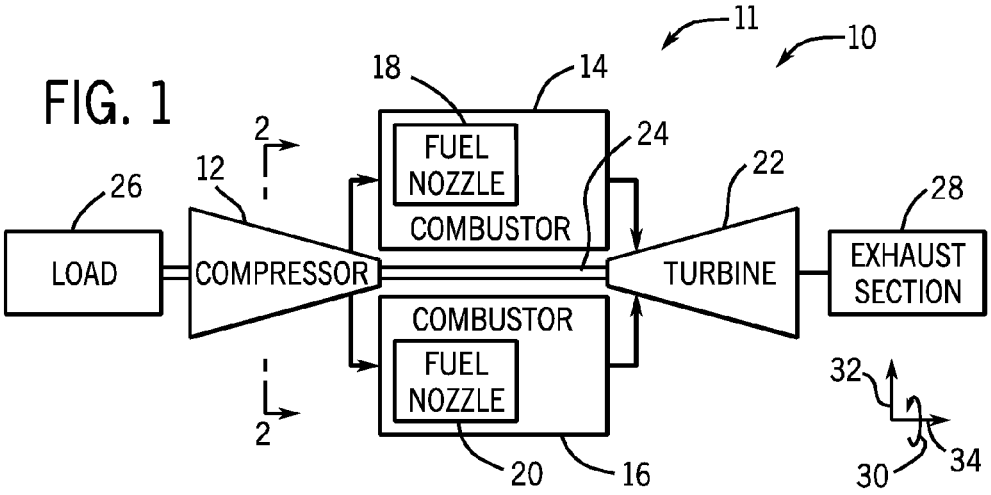
FIG. 1 is a schematic block diagram of an embodiment of a turbomachine system, illustrating a gas turbine engine having a compressor and a turbine.

Turning to the figures, FIG. 1 is a schematic block diagram of an embodiment of a turbomachine system 10 having a blade locking assembly to secure rotary blades. As illustrated, the system 10 includes a gas turbine engine 11 having a compressor 12, combustors 14 and 16 with respective fuel nozzles 18 and 20, a turbine 22, a shaft 24, a driven load 26, and an exhaust section 28. In the following discussion of FIGS. 1-13, reference may be made to a circumferential direction or axis 30, a radial direction or axis 32, and an axial direction or axis 34. The axial direction or axis 34 corresponds to a rotational axis of the system 10, while the circumferential direction 30 extends around the axis 34, and the radial direction 32 extends away from the axis 34. In the illustrated embodiment, the compressor 12 and the turbine 22 each include one or more stages, wherein each stage includes a plurality of rotary blades that may be secured to a respective rotor by a blade locking assembly as discussed in detail below.

In operation, the compressor 12 receives and compresses an air flow through one or more stages of rotary compressor blades. The fuel nozzles 18 and 20 mix fuel with the compressed air flow to generate an air-fuel mixture in the combustors 14 and 16, which then combust the mixture to generate hot combustion gases. The compressed airflow also may provide cooling for the combustors 14 and 16 and other components of the gas turbine engine 11. The hot combustion gases then flow through the turbine 22, thereby driving one or more stages of rotary turbine blades. The rotation of the turbine 22 causes rotation of the shaft 24, which in turn drives the compressor 12 and the load 26 (e.g., an electrical generator). Finally, the combustion gases pass through the exhaust section 28.

As noted above, the compressor 12 and/or the turbine 22 may include a blade locking assembly configured to secure blades to a respective rotor without deforming the rotor (e.g., without staking or welding). For example, rather than staking the rotor, at least one insert may be deformed to serve as a blockage or lock, thereby holding the blade in place relative to the rotor. Subsequently, removal and replacement of the blade may be achieved by severing the deformed insert, discarding the insert, and using a new insert that can be deformed in a similar manner to secure the new blade. In other words, the deformation is performed on a removable, disposable insert, rather on the more expensive, robust rotor. Although the inserts may be used to secure a blade on a rotor of any turbomachine, the inserts of the disclosed blade locking assembly may be particularly well suited for mounting rotary blades on a compressor.

Figure 2:
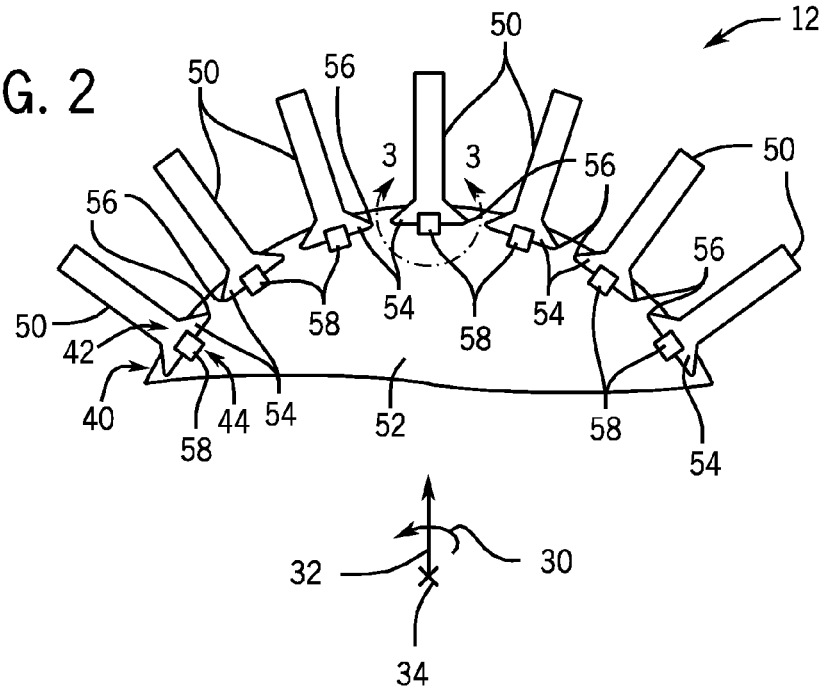
FIG. 2 is a partial cross-sectional view of an embodiment of the compressor of FIG. 1, taken along line 2-2, illustrating an embodiment of a blade locking system.

FIG. 2 is a partial cross-sectional view of an embodiment of the compressor 12 of FIG. 1, taken along line 2-2, illustrating an embodiment of a blade mounting system 40 having a sliding joint system 42 and a blade locking system 44. In the illustrated embodiment, the compressor 12 includes a plurality of compressor blades 50 coupled to a rotor 52 about a circumference of the rotor 52. Each blade 50 includes a base mounting portion 54 (e.g., a sliding joint portion) that mates with the rotor 52 along a corresponding mounting portion 56 (e.g., a sliding joint portion). For example, in the illustrated embodiment, the base mounting portion 54 is a male sliding joint portion, while the mounting portion 56 is a female sliding joint portion. In other embodiments, the base mounting portion 54 is a female sliding joint portion, while the mounting portion 56 is a male sliding joint portion. In either configuration, the mounting or sliding joint portions 54 and 56 may engage and disengage from one another in the axial direction 34 along the rotational axis of the system 10. The sliding joint portions 54 and 56 are configured to hold the blade 50 to the rotor 52 in the circumferential direction 30 and the radial direction 32, while allowing movement in the axial direction 34. Accordingly, the blade locking system 44 is configured to block movement of the blade 50 in the axial direction 34, thereby locking the blade 50 in place relative to the rotor 52. In particular, as discussed in detail below, the blade locking system 44 includes a blade locking assembly 58 configured to interface with the sliding joint portions 54 and 56, and lock the joint portions 54 and 56 together without deforming the rotor 52.

Although the sliding joint portions 54 and 56 may have any suitable shape or configuration, the following discussion of the blade locking assembly 44 refers to the sliding joint portion 54 as an axial rail 54 (e.g., a dovetail shaped axial rail), and refers to the sliding joint portion 56 as an axial groove 56 (e.g., a dovetail shaped axial groove). In certain embodiments, the locking assembly 58 itself is subjected to deformation, such as staking, to hold the locking assembly 58 in the axial groove 56 to block removal of the axial rail 54. For example, the locking assembly 58 may include a plurality of inserts, which are sequentially inserted and then staked together along the axial groove 56. Once staked together, the inserts are held in place along the axial groove 56 to block movement of the axial rail 54.

Figure 3:
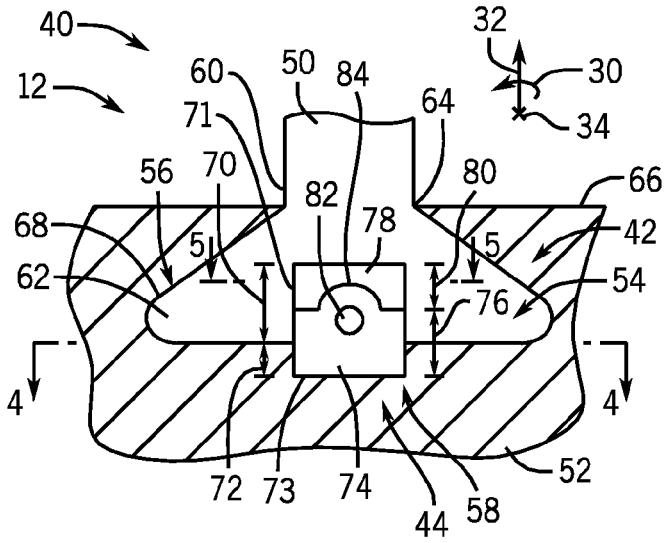
FIG. 3 is a partial cross-sectional view of an embodiment of the blade locking system of FIG. 2, taken within line 3-3.

FIG. 3 is a partial cross-sectional view of an embodiment of the blade mounting system 40 of FIG. 2, taken within line 3-3, further illustrating details of the sliding joint system 42 and the blade locking system 44. The illustrated sliding joint system 42 includes the axial rail 54 of the blade 50 disposed in the axial groove 56 of the rotor 52. However, the configuration may be reversed such that the blade 50 includes the axial groove 56 and the rotor 52 includes the axial rail 54. In either configuration, the axial rail 54 may include a neck portion 60 and an enlarged head portion 62, which generally diverges away from the neck portion 60 to form a substantially triangular shaped head portion 62. In another embodiment, the axial rail 54 may have a T-shaped structure, an L-shaped structure, or the like. Similarly, the axial groove 56 may include an opening 64 along an exterior 66 of the rotor 52, wherein the opening 64 leads into an enlarged cavity 68. The enlarged cavity 68, similar to the enlarged head portion 62, generally diverges away from the opening 64 to form a substantially triangular shaped cavity 68. Again, the illustrated geometry of the axial rail 54 and axial groove 56 is not intended to be limited, and may be replaced with a variety of other axial joint 54 and 56.

The blade locking system 44 includes the locking assembly 58 disposed in opposite recesses 71 and 73 in the blade 50 and the rotor 52, respectively. In particular, the recess 71 is disposed in the axial rail 54 of the blade 50, while the recess 73 is disposed in the axial groove 56 of the rotor 52. The recess 71 has a height 70 in the radial direction 32, while the recess 73 has a height 72 in the radial direction 32. In certain embodiments, the height 70 of the recess 71 may be approximately 1 to 50, 2 to 25, or 5 to 10 mm, and the height 72 of the recess 73 may be approximately 1 to 50, 2 to 25, or 5 to 10 mm. Furthermore, the heights 70 and 72 may be the same or different from one another. For example, the height 70 may be approximately 5 to 500, 10 to 250, 20 to 100, or 30 to 50 percent greater than the height 72, or vice versa. The different heights 70 and 72 may facilitate operation of the locking assembly 58, as discussed in further detail below.

The locking assembly 58 includes a first locking insert 74 with a height 76 in the radial direction 32, and a second locking insert 78 with a height 80 in the radial direction 32. Within the recesses 71 and 73, the first and second locking inserts 74 and 78 are coupled together via a deformation (e.g., staking) 82 of at least one of the inserts 74 or 78. In the illustrated embodiment, the staking 82 is disposed on the first locking insert 74 to secure the second locking insert 78. Once locked in place in the recesses 71 and 73, the locking inserts 74 and 78 of the locking assembly 58 block axial movement 34 of the axial rail 54 relative to the axial groove 56.

During the assembly process, the first locking insert 74 is inserted into the recess 71 in the radial direction 32. After insertion of the insert 74 into the recess 71, the blade is coupled to the rotor 52 by axially sliding the axial rail 54 into the axial groove 56 until the recesses 71 and 73 are aligned with one another (i.e., same axial position). This is followed by lowering the first locking insert 74 from the recess 71 into the recess 73 in the rotor 52 in the radial direction 32. Once inside the recess 73, the first locking insert 74 is unable to move in the axial direction 34 and the circumferential direction 30, although the insert 74 can still move in the radial direction 32. Furthermore, the height 76 of the first locking insert 74 is greater than the height 72 of the recess 73, such that the first locking insert 74 overlaps both recesses 71 and 73 in the radial direction 32. As a result, the first locking insert 74 blocks axial movement 34 of the axial rail 54 relative to the axial groove 56 while overlapping the first and second recesses 71 and 73. Nevertheless, the first locking insert 74 is not yet secured in the recesses 71 and 73, as it can still move in the radial direction 32.

Accordingly, the second locking insert 78 may be inserted into the recess 71 in the axial rail 54 in the axial direction 34, thereby blocking radial movement 32 of the first locking insert 74. As illustrated, the sum of the heights 72 and 74 of the recesses 71 and 73 is substantially equal to the sum of the heights 76 and 80 of the first and second locking inserts 74 and 78. Thus, the inserts 74 and 78 are substantially blocked from moving in the radial direction 32 within the recesses 71 and 73. The inserts 74 and 78 are also secured to one another to block axial movement 34. For example, the second locking insert 78 may be secured to the first locking insert 74 by deformation of one insert relative to the other. Again, the illustrated embodiment depicts the deformation (e.g., staking) 82 disposed on the first locking insert 74, causing a portion 84 of the first locking insert 74 to deform in the radial direction 32 overlapping the second locking insert 78. Thus, the overlapping portion 84 associated with the deformation (e.g., staking) 82 blocks axial movement 34 of the second locking insert 78, such that the insert 78 remains in place to secure the first locking insert 74. Furthermore, the first and second locking inserts 74 and 78 may be coupled together by other mechanisms, such as a welded joint.

The first and second locking inserts 74 and 78 may be made of a heat resistant material, a corrosion resistant material, a wear resistant material, or a combination thereof. For example, the inserts 74 and 78 may be made of various alloys, such as nickel-based steel alloys. Furthermore, the inserts 74 and 78 may be used at one or both ends of the sliding joint system 42 for each blade 50. As discussed below, the recesses 71 and 73 and the inserts 74 and 78 may have a variety of shapes configured to lock the sliding joint system 42.

Figure 4:
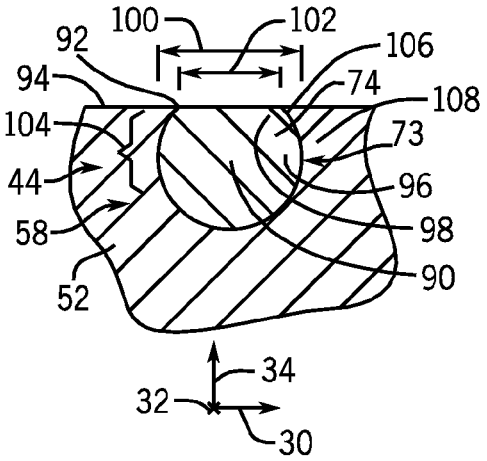
FIG. 4 is a partial cross-sectional view of an embodiment of the blade locking system of FIG. 3, taken along line 4-4.

FIG. 4 is a partial cross-sectional view of an embodiment of the blade mounting system 40 of FIG. 3, taken along line 4-4, further illustrating details of the blade locking system 44 in the sliding joint system 42 (e.g., between the rail 54 and groove 56). As illustrated, the first locking insert 74 is depicted within the recess 73 of the rotor 52 after radially 32 lowering the insert 74 from the recess 71 to the recess 73 as discussed above. The illustrated recess 73 and first locking insert 74 are shaped to block movement of the insert 74 in the axial direction 34. In particular, the recess 73 and the insert 74 have a non-uniform width (e.g., variable width) in the axial direction 34, such that the insert 74 cannot be removed from the recess 73 in the axial direction 34.

The recess 73 and the first locking insert 74 have a first diameter 100 and a second diameter 102 at an axial offset 104 from one another in the axial direction 34, wherein the first diameter 100 is greater than the second diameter 102. For example, the first diameter 100 may be approximately 5 to 200, 10 to 100, or 20 to 50 percent greater than the second diameter 102. The first and second diameters 100 and 102 may be disposed at a variety of axial locations 34 along the recess 73 and the first locking insert 74. For example, the first diameter 100 may be disposed at a generally central or intermediate portion 90 of the recess 73 and the first locking insert 74, while the second diameter 100 may be disposed along an edge portion 92 of the recess 73 and the first locking insert 74. As illustrated, the second diameter 102 is disposed along an axial edge 94 of the rotor 52, such that the edge portion 92 of the recess 73 and the first locking insert 74 is disposed along the axial edge 94.

In other words, the recess 73 includes an opening 96 disposed along the axial edge 94 of the rotor 52, and an enlarged cavity 98 disposed within the rotor 52 in an axial inward direction 34 away from the axial edge 94. The enlarged cavity 98 has the second diameter 102, while the opening 96 has the first diameter 100. Similarly, the first locking insert 74 includes a neck portion 106 disposed along the axial edge 94 of the rotor 52, and an enlarged body portion 108 disposed within the rotor 52 in an axial inward direction 34 away from the axial edge 94. The enlarged body portion 108 has the second diameter 102, while the neck portion 106 has the first diameter 100. In the illustrated embodiment, the recess 73 is a truncated cylindrical recess, and the first locking insert 74 is a truncated cylindrical insert. However, any other shapes may be employed for the recess 73 and insert 74, provided the shapes block axial withdrawal 34 of the insert 74 from the recess 73.

Figure 5:
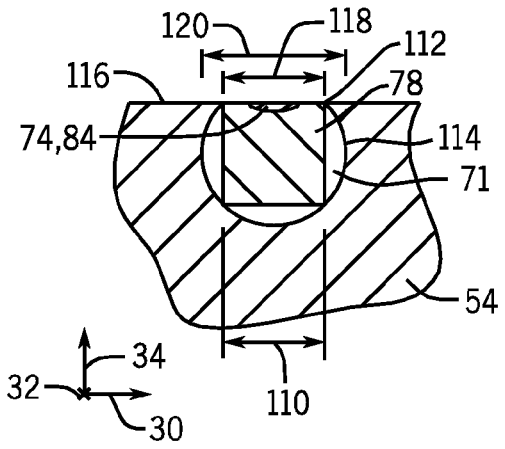
FIG. 5 is a partial cross-sectional view of an embodiment of the blade locking system of FIG. 3, taken along line 5-5.

FIG. 5 is a partial cross-sectional view of an embodiment of the blade mounting system 40 of FIG. 3, taken along line 5-5, further illustrating details of the blade locking system 44 in the sliding joint system 42 (e.g., between the rail 54 and groove 56). The second locking insert 78 is depicted within the recess 71 of the axial rail 54. As illustrated, the second locking insert 78 has a generally rectangular shape, which has a width 110 in the circumferential dimension 30. The recess 71 has an opening 112 and an enlarged cavity 114, wherein the opening 112 is disposed along an axial edge 116 of the rail 54 and the cavity 114 is disposed axially inward 34 away from the axial edge 116. Similar to the recess 73, the illustrated recess 71 is a truncated cylindrical recess with first and second diameters 118 and 120, wherein the second diameter 120 is greater than the first diameter 118. In the illustrated embodiment, the opening 112 of the recess 71 has the first diameter 118, while the enlarged cavity 114 has the second diameter 120. The width 110 of the second locking insert 78 is less than the first diameter 118 of the recess 71, thereby enabling insertion and removal of the second locking insert 78 in the axial direction 34. For example, the first diameter 118 may be approximately 0 to 20 or 5 to 10 percent larger than the width 110. After insertion of the insert 78 into the recess 71, the first locking insert 74 may be deformed (e.g., staked) 82 to extend the portion 84 radially 32 overlapping the second locking insert 78. As a result of the overlapping portion 84, the second locking insert 78 may be axially 34 retained within the recess 71, thereby securing the first locking insert 74. Thus, the first and second locking inserts 74 and 78 are secured together to block axial movement 34 of the axial rail 54 relative to the axial groove 56.

Figure 6:
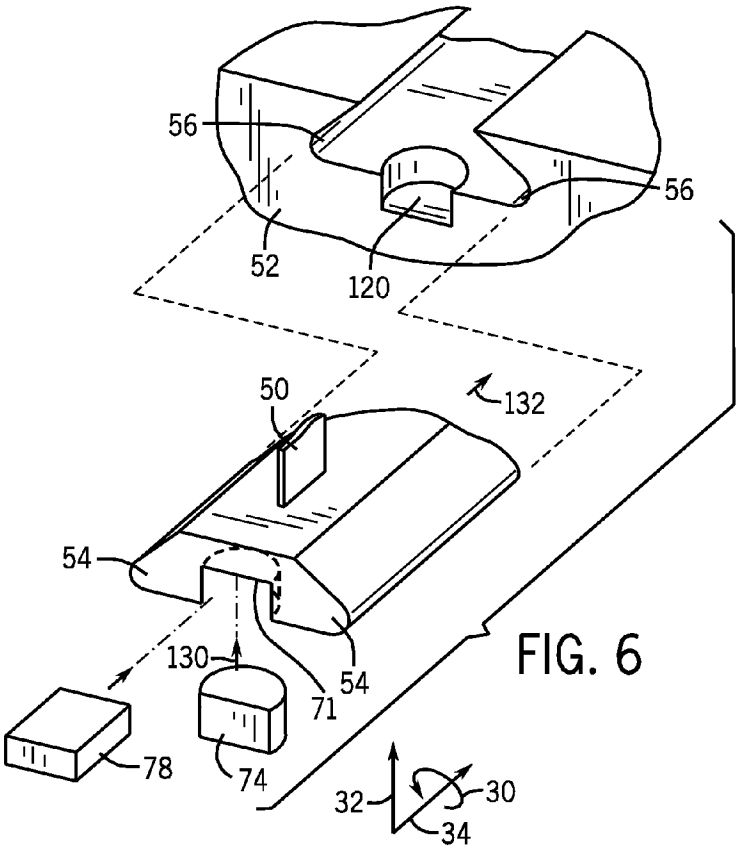
FIG. 6 is a partial exploded perspective view of an embodiment of the blade locking system of FIG. 2, illustrating a blade, first locking insert, and second locking insert exploded from a groove in a rotor.

FIGS. 6 through 9 are partial perspective views of an embodiment of the blade mounting system 40 of FIG. 3, further illustrating steps of mounting the blade 50 to the rotor 52 using the sliding joint system 42 and the blade locking system 44. FIG. 6 is a partial exploded perspective view illustrating an embodiment of the blade 50 having the axial rail 54, the first locking insert 74, and second locking insert 78 exploded from the axial groove 56 in the rotor 52. As discussed above, the first locking insert 74 and the recess 71 (similar to the recess 73) have a truncated cylindrical shape, such that the locking insert 74 cannot be inserted or removed in the axial direction 34 relative to the recess 71.

Figure 7:
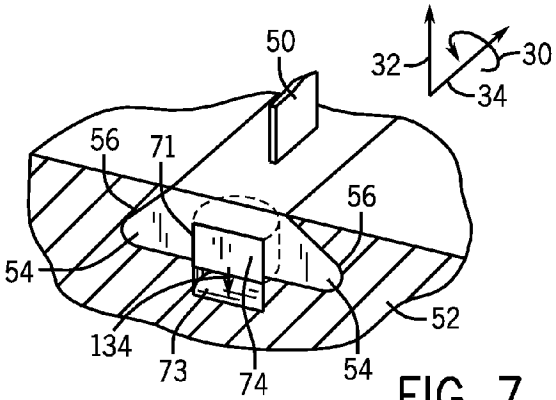
FIG. 7 is a partial cutaway perspective view of an embodiment of the blade locking system of FIG. 6, illustrating the blade and the first locking insert disposed in the groove in the rotor, with the first locking insert in a first position.
Figure 8:
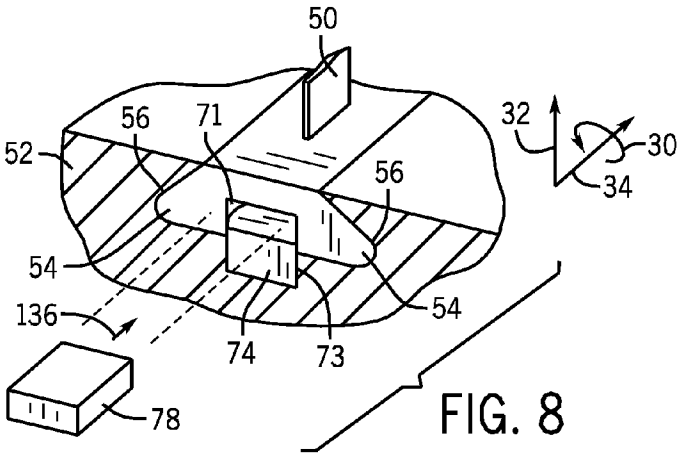
FIG. 8 is a partial cutaway perspective view of an embodiment of the blade locking system of FIGS. 6-7, illustrating the blade and the first locking insert disposed in the groove in the rotor, with the first locking insert in a second position.
Figure 9:
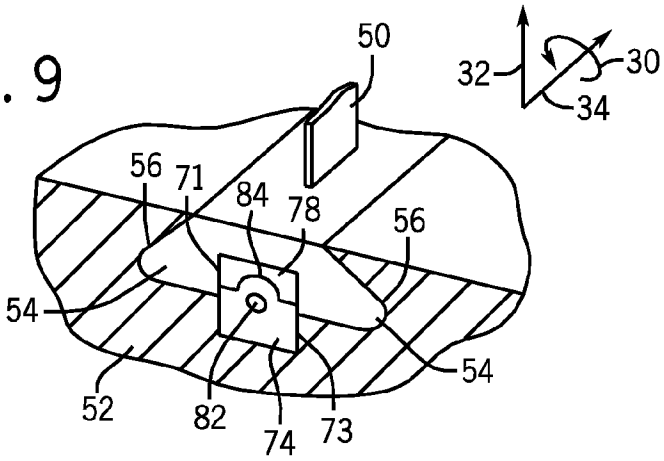
FIG. 9 is a partial cutaway perspective view of an embodiment of the blade locking system of FIGS. 6-8, illustrating the blade, the first locking insert, and the second locking insert disposed in the groove in the rotor, with the first locking insert in a second position secured by the second locking insert.

Accordingly, the first locking insert 74 is inserted into the recess 71 in the radial direction 32, as indicated by arrow 130. After insertion of the insert 74 into the recess 71, the axial rail 54 of the blade 50 may be installed in the axial direction 34 into the axial groove 56, as indicated by arrow 132. The axial rail 54 is moved axially 34 along the axial groove 56 until the recess 71 of the blade 50 is axially aligned with the recess 73 of the rotor 52, as illustrated in FIG. 7. At this stage, as further illustrated in FIG. 7, the first locking insert 74 is lowered from the recess 71 into the recess 73 as indicated by arrow 134. For example, the insert 74 may automatically drop into the recess 73 upon axial alignment of the recesses 71 and 73. As illustrated in FIG. 8, the first locking insert 74 radially overlaps 32 both recesses 71 and 73 in the lowered position of the insert 74, thereby blocking axial movement 34 of the axial rail 54 relative to the axial groove 56. However, the first locking insert 74 is still capable of moving in the radial direction 32, and thus the axial rail 54 is not completely secured to the axial groove 56 at this stage. As further illustrated in FIG. 8, the second locking insert 78 is inserted axially 34 into the recess 71 on top of the first locking insert 74, as indicated by arrow 136. Once the insert 78 is disposed above the insert 74, the inserts 72 and 74 may be coupled together to completely secure the axial rail 54 within the axial groove 56. FIG. 9 illustrates a deformation (e.g., staking) 82 in the first locking insert 74, which causes the portion 84 of the insert 74 to radially 32 overlap the second locking insert 78. At this stage, the first locking insert 74 blocks axial movement 34 of the axial rail 54 relative to the axial groove 56, the second locking insert 78 blocks radial movement 32 of the first locking insert 74, and the deformation (e.g., staking) 82 blocks axial movement 34 of the second locking insert 78 relative to the axial rail 54. In this manner, the inserts 74 and 78 completely secure the axial rail 54 to the axial groove 56 without directly staking the rotor 52 or the blade 50.

Figure 11:
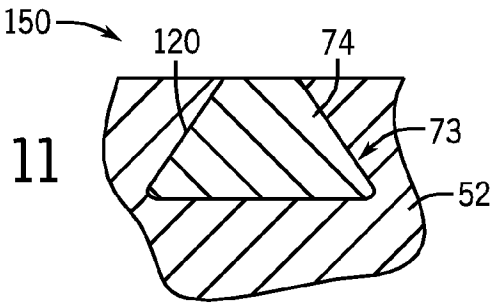
FIG. 11 is a partial cross-sectional view of an embodiment of the blade locking system of FIG. 3, taken along line 4-4; illustrating a wedge-shaped locking interface of the blade locking system of FIG. 2.
Figure 12:
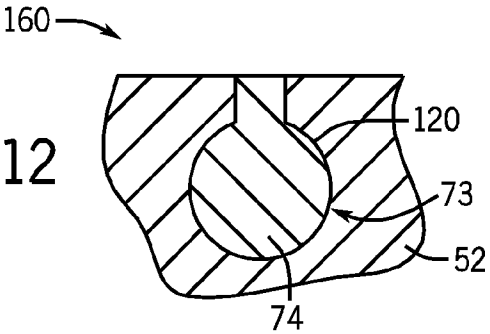
FIG. 12 is a partial cross-sectional view of an embodiment of the blade locking system of FIG. 3, taken along line 4-4; illustrating a bulb-shaped locking interface of the blade locking system of FIG. 2.
Figure 13:
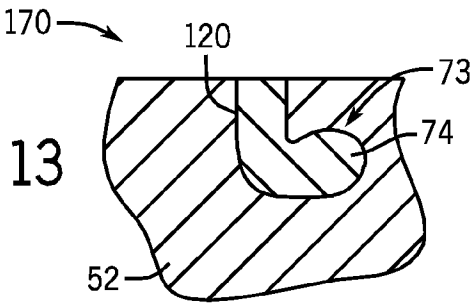
FIG. 13 is a partial cross-sectional view of an embodiment of the blade locking system of FIG. 3, taken along line 4-4; illustrating an L-shaped locking interface of the blade locking system of FIG. 2.
Figure 10:
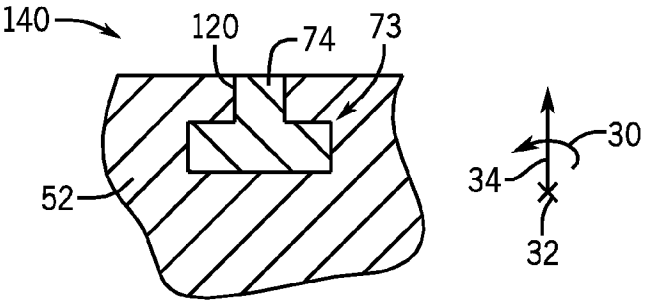
FIG. 10 is a partial cross-sectional view of an embodiment of the blade locking system of FIG. 3, taken along line 4-4; illustrating a T-shaped locking interface of the blade locking system of FIG. 2.

FIGS. 10 through 13 are partial cross-sectional views of embodiments of the blade locking system 44 of FIG. 3, taken along line 4-4; illustrating different locking interfaces between the recess 73 and the first locking insert 74. Furthermore, although not depicted in these figures, recess 71 of FIG. 3 may have any of the geometric shapes depicted in FIGS. 10 through 13. For example, FIG. 10 illustrates a T-shaped locking interface 140, wherein the recess 73 and the first locking insert 74 both have a T-shaped geometry. FIG. 11 illustrates a wedge-shaped locking interface 150, wherein the recess 73 and the first locking insert 74 both have a wedge-shaped geometry. FIG. 12 illustrates a bulb-shaped locking interface 160, wherein the recess 73 and the first locking insert 74 both have a bulb-shaped geometry. FIG. 13 illustrates an L-shaped locking interface 170, wherein the recess 73 and the first locking insert 74 both have an L-shaped geometry. In each of the embodiments of FIGS. 10 through 13, the locking interfaces 140, 150, 160, and 170 block axial movement 34 of the insert 74 relative to the recess 73, while allowing radial movement 32 of the insert 74 relative to the recess 73. Thus, the second locking insert 78 is subsequently installed to block the radial movement 32 of the first locking insert 74. In other embodiments, a variety of other shapes may be used for the insert 74 and recess 73 (and recess 71 depicted in FIG. 3), provided that the shapes block axial movement 34.

Technical effects of the disclosed embodiments include providing systems for improving the longevity of a turbomachine rotor 52. The disclosed blade locking system 44 enables blades 50 to be installed and secured on a turbomachine 10, such as a compressor. When the blades 50 are secured, the improved design incorporated into the blade locking system enables the turbomachine rotor 52 to retain its supporting shape and not be deformed, even with multiple blade 50 replacements. Instead of deforming the rotor 52, the locking assembly 58 may be deformed. The locking assembly 58 may be generally easier to install and cost less than a turbomachine rotor 52. Thus, the improved design enables the turbomachine rotor 52 to have an increased usable life and reduced costs associated therewith. Likewise, the improved design enables turbomachine blades 50 to be replaced when needed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbomachine blade comprising a blade portion extending from a base portion, wherein the base portion comprises an axial rail configured to extend into an axial groove disposed in a rotor of a turbomachine, and the axial rail comprising a first locking recess configured to align with a second locking recess along the axial groove; and a blade locking assembly comprising a first locking insert and a second locking insert, wherein the first locking insert is configured to be inserted in both the first and second locking recesses, and the second locking insert is configured to be inserted in the first or second locking recess adjacent the first locking insert, wherein the axial rail comprises a first lateral opening extending into the first locking recess in an axial direction, the axial rail blocks movement of the first locking insert through the first lateral opening in the axial direction, and the axial rail enables movement of the second locking insert through the first lateral opening in the axial direction.

2. The system of claim 1, wherein the first and second locking inserts are staked relative to one another.

3. The system of claim 1, wherein the axial rail is configured to extend into the axial groove to block movement of the turbomachine blade relative to the rotor in a radial direction and a circumferential direction relative to a rotational axis of the rotor.

4. The system of claim 3, wherein the blade locking assembly is configured to block movement of the turbomachine blade relative to the rotor in the axial direction relative to the rotational axis of the rotor.

5. The system of claim 3, wherein the axial rail comprises a dovetail shaped rail configured to mount in a corresponding dovetail shape of the axial groove.

6. The system of claim 1, wherein the first locking recess extends into the axial rail in a radial direction relative to a rotational axis of the rotor.

7. The system of claim 1, wherein the first locking insert has a first radial dimension and a first circumferential dimension relative to the rotational axis of the rotor, the second locking insert has a second radial dimension and a second circumferential dimension relative to the rotational axis of the rotor, the first radial dimension is greater than the second radial dimension, and the first circumferential dimension is greater than the second circumferential dimension.

8. The system of claim 1, wherein the first locking insert comprises a cylindrical insert, and the second locking insert comprises a rectangular insert.

9. The system of claim 1, wherein the first locking insert comprises a wedge-shaped, T-shaped, L-shaped, or bulb-shaped insert.

10. The system of claim 1, wherein the first and second locking inserts comprise an alloy steel, nickel alloy, a heat resistant material, or a corrosion resistant material.

11. A system, comprising:

a turbomachine, comprising:

a rotor having a first axial groove;

a first blade having a first axial rail disposed in the first axial groove;

a locking space extending into the first axial groove and the first axial rail;

at least one locking insert disposed in the locking space, wherein the at least one locking insert blocks movement of the first axial rail relative to the first axial groove in an axial direction, wherein the locking space comprises a first locking recess extending radially into the first axial rail and a second locking recess extending radially into the first axial groove, and the first and second locking recesses have different radial depths than one another; and a lateral opening extending into the locking space in the axial direction, wherein the locking space is sized greater than the lateral opening in a direction crosswise to the axial direction.

12. The system of claim 11, wherein the at least one locking insert comprises a first locking insert and a second locking insert.

13. The system of claim 12, wherein the first and second locking inserts are staked relative to one another.

14. The system of claim 12, wherein the second locking insert retains the first locking insert within the locking space, and the first locking insert blocks movement of the first axial rail relative to the first axial groove in the axial direction while retained in the locking space.

15. A system, comprising:

a compressor, comprising:

a first blade having a first axial mount;

a rotor having a second axial mount, wherein the first and second axial mounts couple together in an axial direction to block movement of the first axial mount relative to the second axial mount in a radial direction and a circumferential direction;

a locking space extending into the first axial mount and the second axial mount;

at least one locking insert disposed in the locking space, wherein the at least one locking insert blocks movement of the first axial mount relative to the second axial mount in the axial direction, wherein the locking space comprises a first locking recess extending radially into the first axial mount and a second locking recess extending radially into the second axial mount, and the first and second locking recesses have different radial depths than one another; and a lateral opening extending into the locking space in the axial direction, wherein the locking space is sized greater than the lateral opening in a direction crosswise to the axial direction.

16. The system of claim 15, wherein the at least one locking insert comprises a first locking insert and a second locking insert, and the first and second locking inserts are staked relative to one another.

* * * * *